United States Patent [19]

Montone

[11] Patent Number: 4,971,326

[45] Date of Patent: Nov. 20, 1990

[54] PRACTICE DEVICE FOR GOLFERS

[76] Inventor: Liber J. Montone, 9242 Vanderbilt Dr., Naples, Fla. 33963

[21] Appl. No.: 343,591

[22] Filed: Apr. 27, 1989

[51] Int. Cl.[5] ..... A63B 69/36

[52] U.S. Cl. ..... 273/185 C; 273/200 R

[58] Field of Search ..... 273/200 R, 185 R, 184 B, 273/196, 198, 26 E

[56] References Cited

U.S. PATENT DOCUMENTS 4,071,250 1/1978 Vroome ..... 273/200 R

*Primary Examiner*—George J. Marlo

*Attorney, Agent, or Firm*—Gregory E. Montone

[57] ABSTRACT

An indoor-outdoor golf practice device for use with all golf club woods, irons and wedges wherein a light-weight practice golf ball is attached with a selectable length cord to a single fold-over, flexible flap. The flap contains one or more small calibration weights at its opening end and covers distance-marker scales, with each scale corresponding to a particular range to be measured. The kinetic energy at a particular point in the flight trajectory of the well-hit light-weight properly positioned practice ball, which simulates a roughly 250 yard drive is sufficient to fully open the fold-over flap with a 10 foot tether cord, thus exposing the high range full scale markers up to 250 yards. Similarly, the poorly hit practice ball contains less kinetic energy at the same selected point from the flap in its flight trajectory, and only partially opens the flap which exposes lower yardage markers indicating a low quality drive for short iron and wedge strokes, a shorter effective length of tether cord is used to utilize an equivalent power point on shorter ball flight trajectories, making possible multiscale operation with improvement in scale readout resolution on low power ball flight trajectories.

9 Claims, 2 Drawing Sheets

PRACTICE DEVICE FOR GOLFERS

FIELD OF THE INVENTION

This invention relates to an indoor-outdoor golf practice device which is durable, low in cost, can be carried in the pocket of a golf bag and can be safely used on any ground or floor surface which has enough space to swing a golf club and has 10 feet or more of unobstructed length.

BACKGROUND OF THE INVENTION

Golf is a popular sport which has been played in many countries throughout the world and is increasing in popularity with young and old since the advent of televised tournaments.

The game challenges golfers to acquire precision and maintain ball hitting skills with a variety of clubs, on balls which may, be on a tee, virtually buried in a trap, or anything in between. Thus, delicate timing, tempo, proper swing, stance, balance, and grip are necessary to achieve the control required to make good shots with reasonable consistency. No human with his or her inherent physical limitations combined with golf's companion mental strains and insidious variables, can seriously expect perfect execution of every shot, every time.

To play well, proper instruction and considerable practice are required. This is usually followed by intermittent periods of analysis of repetitive errors, followed by more practice including corrective measures etc. and the cycle is then repeated many times.

Many amateur players appear to concentrate their practice efforts on attempts to hit long straight drives, and accordingly, go to golf driving ranges where actual shots may be observed. Chip-and-putt courses also have this actual ball flight observation benefit. Unfortunately, these practice facilities are not always easily accessible and, in addition, their use is dependent on open-for business hours and weather conditions.

To circumvent the above limitations, many tethered ball hitting practice devices have been developed in recent years. These vary in complexity and intent. The relatively simple devices consist of a practice ball tethered by a cord to a spike driven into the ground. With such a device the user primarily practices his swing and the associated factors. A more sophisticated tee shot practice device is described in U.S. Pat. No. 4,609,197. This device tees the ball on top of a hollow (in the ground) spike which contains the tether shock cord and has an impact measuring device attached to the upper end of the spike. Thus, the user has an additional indication of the club-to-ball impact power.

Two more versatile and sophisticated golf practice devices are described in U.S. Pat. No. 4,118,032 and U.S. Pat. No. 4,139,197. These practice devices contain distance and direction scales which are staked to the ground and connected by a tether cord, to the practice ball a few feet away, thus the user of these devices has additional information to evaluate the quality of his practice strokes. The main disadvantages of these practice devices are that, first their uses are limited to ground type areas where stakes or spikes can be driven and second, their gauges and scales function by a sequence of activity by springs, pivots, drums, brakes guides, and other active mechanical parts which are not only costly to manufacture but also subject to malfunction caused by moisture, dirt, and the other elements of an outdoor environment.

A golf practice device which circumvents the above disadvantages is titled, "GOLF PRACTICE DRIVE ANALYSER," and is described in U.S. Pat. No. 4,071,250. This device has only four essential parts. The driving ball is anchored to one end of a mat, which has distance marker indicia across the mat surface, by a tether which has two parts. The anchor end of the tether is a chain made of links of uniform weight and length. The chain links are positioned across the full scale of marker indicia on the mat and terminate on the "0" yard marker. The second end of the tether consists of a substantially weightless flexible cord which connects the "0" marker link of the chain to the practice ball which is positioned a few feet away. When hit by the driving golf club, the ball travels over the mat in a brief free flight which is gradually reduced in velocity as the uniformly weighted chain is picked up thereby absorbing the kinetic energy of the ball before the full length of the chain is used. The position and length of the displaced tether chain laying on the mat indicate the direction and distance of the simulated flight of the ball.

One disadvantage in the use of the above-described device is the probable safety hazard involved. Since the very safe lightweight (½ ounce or so) perforated plastic or cotton practice balls do not have the inertia on their flight trajectories to displace even a light chain, something heavier would have to be used to fill the chain displacement requirements. Thus, if the substantially weightless flexible segment of the tether cord was caught between the ball and the sharp bottom of a club face during impact and cut, a potentially hazardous situation might be caused by the run-away ball.

In general, an additional disadvantage of all the practice devices described is that their inherent physical characteristics limit their distance readout resolution to only one scale. For example, these devices may clearly indicate the stroke quality differences between a 150 yard drive and a 200 yard drive, but the same device cannot determine or resolve the quality differences between 25 yard and 20 yard chipping strokes.

SUMMARY OF THE INVENTION

An object of the present invention is to provide a low cost, reliable golf practice device which employs an inherently safe captive ball.

A further object of the invention is to provide a golf training device which clearly indicates golf stroke-ball impact quality by indicating distance and degrees of hooking or slicing, with high repeatability from stroke to stroke.

Yet a further object of the invention is to provide a captive ball golf practice device for use on indoor or outdoor surfaces such as concrete slabs, wood floors, black top driveways, grass lawns, etc. with interchangeable ball support mats which simulate realistic golf course fairways, roughs and the like.

A still further object of the invention is to provide a golf training device which can be utilized with all regulation golf clubs (with the exception of putters) with optimized readout ranges for the particular club being used.

Another object of the invention is to provide a golf practice device which can be rolled up, carried in a golf bag pocket, and be readily used for 'warm up' prior to golf course play.

These and other objects in the present invention are achieved by a golf practice device which comprises a very light weight plastic ball which is attached by a suitable length coupling tether cord to the opening end of an asymmetrical rectangular, single fold-over, flexible flap which is made of vinyl (e.g., imitation leather) or other material with similar characteristics. The fold-over flap contains a small pocket across its opening end into which calibration weights may be inserted. The flap covers a number of simulated ball flight distance ranges, with preferably, at least a driver and long iron high range of about 250 yards at full scale with 25 scale divisions, each division indicating 10 yards of simulated ball flight, and a chipping iron and wedge low range with a full scale of about 25 yards, with each of the scale divisions indicating 1 yard of simulated ball flight. The device may be readily calibrated for in-between ranges which may be placed on the back of the fold-over indicating flap, if desired, as will be seen shortly.

The practice ball is preferably of regulation ball size, of aerodynamic design which simulates actual ball flight with an attenuated flight trajectory, and made of perforated plastic material weighing about one-half of an ounce.

When this ball is well hit with a driver, the vectorial forces at roughly 10 feet from the opening end of the fold-over indicating flap, in the flight trajectory of the ball which simulates an actual golf ball flight of about 200 airborne yards, are sufficient to open the single fold-over flap (calibrated end weight at 1 oz.) roughly 20 inches. This will expose about 20 of the 10 yard markers, thereby indicating a 200 yard simulated golf ball flight. Proper ball positioning, tether cord length, calibration weight, and other parameter selections are set to display valid distance data approximating actual golf ball airborne flight when similarly hit.

The vectorial forces in the flight trajectory, with the same parameters operating as above, of a poorly hit practice ball simulating a 100 yard ball flight, are only one-half of those above. Thus these forces when transmitted via the tether cord are sufficient to open the energy-absorbing fold-over flap enough to only expose about 10 of the 10 yard markers, since the flap opening distance is in direct proportion to the ball kinetic energy at the selected flight trajectory point. Therefore, flight distances of golf strokes may be compared. Direction of the flight path of the ball is indicated by the centerline of the open flap so that hooks and slices are also detected. Arrow heads placed on the centerline facilitate readout.

The inherently stable, easy to clean, passive elements and materials used in this device results in consistent high repeatability, from stroke to stroke, when this device is used in wind-free environments.

The chipping and wedge low range operates in a similar manner, but requires a shortening of the effective length of tether cord because a 20 yard chip would otherwise indicate only about two 10 yard scale divisions on the 250 yard scale, and a 25 yard chip would be only 2½ divisions, which is about the limit of resolution capability of this range. Of course, this low degree of resolution worsens if one wanted to practice 5 and 8 yard chips, so that the device would be virtually worthless for this if the tether cord is not shortened.

Shortening the effective length of the tether cord moves the fold-over indicating flap actuation point to a higher kinetic energy point of the ball flight trajectory curve because the ball energy is on a rapidly declining slope as a function of distance from the initial ball position when struck by the golf club. This is conveniently accomplished in the present invention by moving the ball lie position farther from the opening end in the hinge direction, of the fold-over indicating flap, to a 9 foot distance between the ball lie position and the tether cord tie point on the indicating fold-over flap for the parameters described. This results in a full scale flap opening of 25 yards. Thus, a 5 yard chip would indicate 5 scale divisions and an 8 yard chip would uncover 8 scale division, which clearly indicates chipping stroke quality differences.

Positioning the ball such that the actuation point is about 5 feet on the flight trajectory path of the practice ball would require a simulated flight of about 125 yards to provide a full flap opening of the fold-over indicating flap, thus a midrange scale for the shorter mid-irons can easily be implemented. Mid-range scale yardage marker indicia can also be placed on the back of the fold-over indicating flap, adjacent to the ball flight direction indicating arrow line. In this manner, an additional range can be provided without cluttering the other scale indicia.

Advantageously, the present invention provides a simple, low cost portable golf practice device which gives the user repeatable information for each shot indicating distance and direction for a broad range of golf club use. The user can easily evaluate this information to improve at option, the various particular desired segments of golf.

DESCRIPTION OF THE PREFERRED EMBODIMENT

Figure 1:
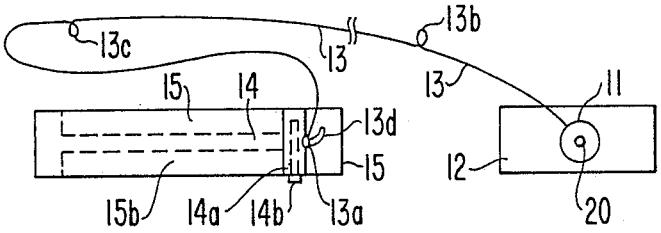
FIG. 1 is a plan view of the preferred embodiment, showing the practice ball positioned for long range scale operation.

Referring now to FIG. 1, for long range stroke evaluation of wood and long iron shots, the practice ball 11, which may preferably be a typical regulation size, perforated plastic type, is teed or resting at position 20 on the mounting structure 12, which may be a mat, rug, grass plot, or similar surface which simulates the desired lie. The mounting structure 12 should be capable of absorbing the energy of impact of a badly swung golf club head without damaging the club. Hereinafter, the mounting structure 12 will simply be referred to as mat 12.

The tether cord 13 is of strong, durable, light-weight flexible material, such as nylon. By way of example, the cord 13 can be 10 feet long for the particular parameters selected, although this length may vary with parameter changes. The cord 13 is attached to ball 11 resting at position 20 which is about one foot distant from the flap tie point 13*a* of tether 13 at the opening end of fold-over flap 14. By way of example, the flap 14 can be made of five mil imitation leather vinyl upholstery or similar material. Flap 14 contains, at tether cord 13 tiepoint 13*a*, a folded pocket 14*a* across its opening width, to add desired rigidity and to hold inserted calibration weights, 14*b* which ideally may be made of one ounce 20 penny nails, spikes, or similar weights, as required. The excess length of tether cord 13 randomly lays off flap 14 and mat 12.

The player uses the device by taking his stance, addressing the ball 11, going through his usual wiggle and swing routine, and hitting the ball 11, just as he would hit an actual golf ball with a driver or long iron.

Figure 2:
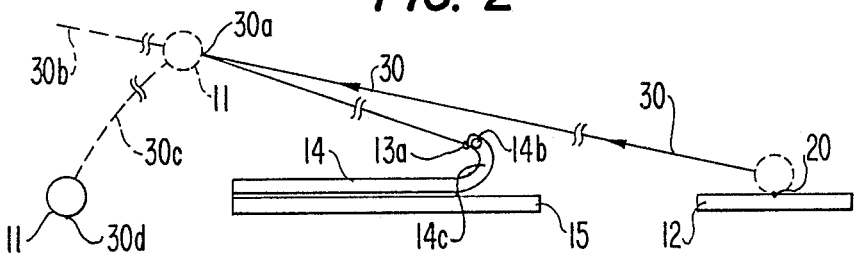
FIG. 2 is an elevation view showing the beginning of the transition period of driven practice ball vectorial force kinetic energy to proportional indicating fold-over flap opening.
Figure 3:
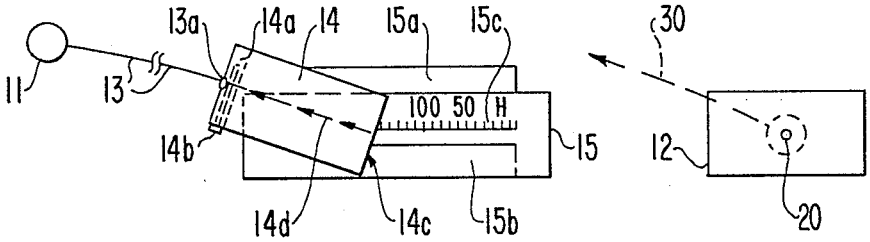
FIG. 3 is a plan view showing the quiescent resultant readout period after total absorption of practice ball kinetic energy, of a poorly hit, sliced drive.

The practice ball 11 embarks on its flight excursion, as shown in FIG. 2, simulating an attenuated flight path of an actual golf ball, similarly hit, for eleven feet when the loose tether cord 13 becomes fully extended and taut at point 30*a* terminating an untethered flight trajectory as shown by 30*b*. At point 30*a* the kinetic energy of the flying ball 11 equates to vectorial thrust force which is transmitted via tether cord 13 to tether cord tiepoint 13*a*, at the opening end of the flexible flop-over flap 14, which then flops over and moves in the direction of the ball 11 vectorial force. The flap 14 exerts counter drag force on the ball 11 as flap 14 continues to roll over at moving roll-over fold 14*c*, continuously expending ball 11 energy (kinetic) for the duration of flight trajectory interval 30*c*. The flight terminates at point 30*d* where the kinetic energy of ball 11 is totally expended and the quiescent state is reached, as shown in FIG. 3.

The amount and direction of flap 14 displacement beyond flap roll-over fold 14*c* reflects the direct proportion kinetic energy of the ball 11 during the flight interval 30*c* which began at point 30*a* and continued to point 30*d* as shown in FIG. 2. In FIG. 3, the displacement of flap 14, uncovered about 14 markers on a high (H) range indicator 15*c*. Each marker on this range represents about 10 yards, so that, in this example, the simulated golf ball flight is about 140 yards. The direction of ball flight in this example is shown by direction arrow 14*d* as a slice for a right-handed golfer. Optional H range 15*c* cover flap 15*a* is shown in the open position to expose the range markers 15*c* in use. Range cover flap 15*a* and 15*b* are preferably of similar material as device base 15 which may also be 5 mil flexible vinyl imitation leather upholstery material.

Figure 4:
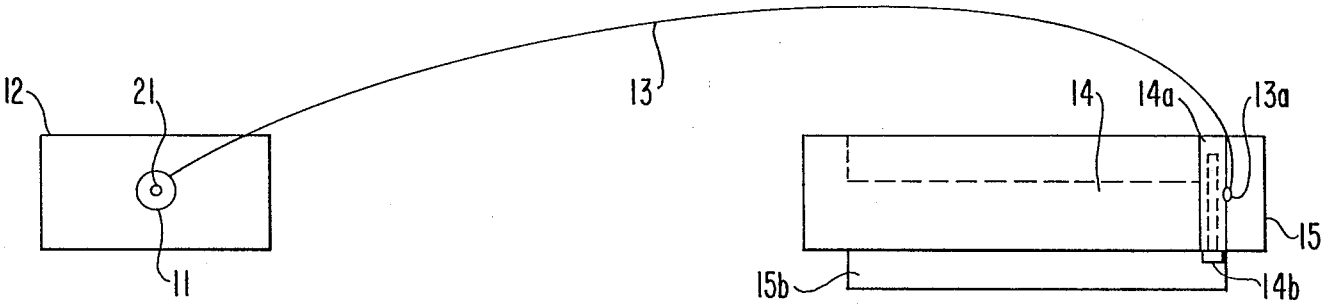
FIG. 4 is plan view showing the practice ball positioned for chipping iron and wedge short range scale operation.

FIG. 4 shows the practice ball 11 position 21 for chipping iron and wedge L(ow) range shots for a 10 foot tether cord 13.

For the L range, the mat is positioned in front of the flap 14 such that the practice ball 11, resting on position 21, is about 9 feet from tether cord 13 tiepoint 13*a* on flap pocket 14*a*. Optional range cover 15*b* is in the open position so that fold-over flap 14 will, when open, expose the markers of an L range indicator 15*d*. Each such marker indicates about one yard of simulated ball flight per division.

For chipping iron and wedge use, the golfer assumes a short stroke stance and strikes the practice ball 11 with a very low-power partial swing. Thus the kinetic energy available from such a stroke, which is required to activate flap 14, causes fold-over 14*c*, and the full flap opening appears to be limited to a full scale opening of a two foot long flap 14 to a 25 yard low range. To achieve reliable operation on this range, the ball 11 embarks on its flight excursion just as it did on FIG. 2 for high range, except that the ball 11 is allowed to fly 1 foot, instead of 11 feet. At that point, the tether cord 13 becomes taut and activates the kinetic energy of ball 11 transition to flap 14 end at tether cord tiepoint 13*a*, causing flop-over, generation of movement of roll-over fold 14*c*, and flap 14 displacement.

Figure 5:
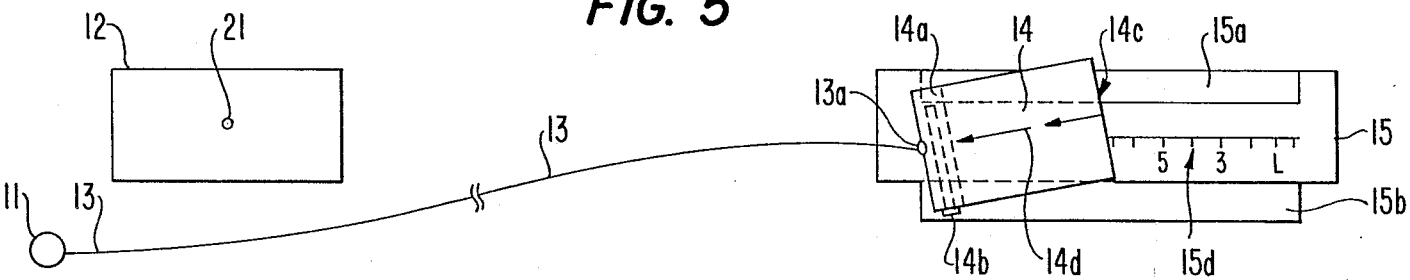
FIG. 5 is a plan view showing the quiescent readout period following a slightly hooked 7 yard chipped shot.

FIG. 5 shows the quiescent readout state of a 7 yard chipped ball. The direction arrow 14*d* indicates a slight hook.

Range cover flap 15*b* is in the open position to expose L range marker indicia 15*d* of 7 yards of indicating roll-over flap 14 displacement.

The results achieved by positioning the practice ball 11 in position 21 as shown in FIG. 4 for L range use can readily be duplicated by placing the practice ball 11 in position 20 as shown in FIG. 1 and connecting lightweight latching hook 13*d* to L range loop 13*b*. This shortens tether cord 13 to about 1.5 feet. The kinetic energy of ball 11 on flight trajectory 30 then operates flap 14 roll-over and activation point 30*a* at the one foot point in ball 11 flight trajectory 30, thus the requirements for L scale calibration validity are complied with. Similarly, attaching latching hook 13*d* to loop 13*c* provides an additional range, when calibrated. It should be noted that initial calibration errors, while not desired, can be tolerated because such carelessness results in a sum-total offset and does not affect stroke-to stroke repeatability, which is essential for stroke comparision and player improvement.

Within the spirit and scope of the invention herein, it is appropriate the the appended claims be broadly interpreted.

What is claimed is:

1. A portable golf practice device comprising:

a lightweight practice golf ball adapted to be placed on one of a plurality of predetermined positions;

a flexible selectable-length tether cord having one end attached to said practice golf ball;

a flexible fold-over flap attached to the other end of said tether cord, wherein said flap has a movable opening end and a fixed end, and further wherein said flap folds over at the opening end and moves in the direction of flight trajectory of said practice ball when said practice ball is hit with a golf club and when said tether cord becomes fully extended thus transmitting the kinetic energy of said practice ball at a preselected point in said flight trajectory to said flap causing initial fold-over of said flap and displacement of said flap in direct proportion and direction for the duration of said kinetic energy of said practice ball; and a marker scale found under said flap and which is exposed when said flap is opened, wherein said marker scale indicates the direction and magnitude of said practice ball kinetic energy at the preselected point in said flight trajectory.

2. A device as set forth in claim 1 wherein a plurality of said marker scale is provided under said flap with each of said marker scales calibrated to a different distance range.

3. A device as set forth in claim 2, wherein each of said predetermined positions of said practice ball is addressed to and designated as functional for a particular scale of said plurality of marker scales.

4. A device as set forth in claim 2, wherein each selected length of said selectable length tether cord is addressed to and designated as functional for a particular scale of said plurality of marker scales.

5. The device as set forth in claim 1, wherein said fold-over flap contains a pocket at said flap opening end to carry calibration weights to validate and improve accurracy of said marker scale.

6. A device as set forth in claim 1 wherein said flap and base sheet are a single piece.

7. A device as set forth in claim 1 wherein said fixed end of said flap is attached to a base sheet.

8. A device as set forth in claim 7 wherein said base sheet is formed of a foldable material.

9. A device as set forth in claim 8 wherein said base sheet is formed of the same material as said flap.

* * * * *